United States Patent [19]

Bennett

[11] Patent Number: 4,790,339

[45] Date of Patent: Dec. 13, 1988

[54] MULTI-PURPOSE STICK

[76] Inventor: Devane D. Bennett, 120B Enoch Ave., Fayetteville, N.C. 28301

[21] Appl. No.: 97,052

[22] Filed: Sep. 16, 1987

[51] Int. Cl.[4] ..... A45B 7/00; A45B 9/00

[52] U.S. Cl. ..... 135/65; 135/68

[58] Field of Search ..... 135/65–68; D3/7

[56] References Cited

U.S. PATENT DOCUMENTS 143,248 9/1873 Pevey ..... 135/65

2,388,778 11/1945 Wheeler ..... 135/68

3,157,187 11/1964 Murcott ..... 135/68

3,550,602 12/1970 Hesterman ..... 135/65

*Primary Examiner*—J. Karl Bell

*Attorney, Agent, or Firm*—Rhodes, Coats & Bennett

[57] ABSTRACT

This invention is a multi-purpose stick which can be used as a walking stick, a leg support, an arm lifter, a leg and arm support, and the like. This is all accomplished through the provision of a stick which has a plurality of bends formed therein to make it suitable for multiple uses.

7 Claims, 2 Drawing Sheets

MULTI-PURPOSE STICK

FIELD OF INVENTION

This invention relates to orthopedics and more particularly to multi-purpose walking type sticks.

BACKGROUND OF INVENTION

The weak and infirm have historically had problems not only walking but lifting their legs and arms in and out of bed, in and out of seats, and the like. If a weak or infirm person is traveling, a companion in many cases must accompany them to help lift their legs in and out of seats such as automobiles, help them get up and sit down, and accomplish similar manuevers. Because companions are not always available, the weak and infirm quite often are confined to their homes or places of abode.

Although walking sticks, crutches, and the like can help a person in walking from one location to another, they are quite often more hinderance than help when getting in and out of bed, in and out of seats, in and out of vehicles, and the like.

SUMMARY AND OBJECTS OF THE INVENTION

After much research and study into the above mentioned problems, the present invention has been developed to provide a universal walking stick which allows the user thereof to accomplish many manuevers which in the past have been either difficult or impossible to accomplish without help.

This is accomplished through the provision of a stick with a relatively straight elongated portion and three distinct bent or bowed portions. Through use of this multi-purpose or universal stick, a person whose leg has been cut off can wrap one of the curved portions around his arm, brace with his hand and walk. Also it can be used for and manuevering by people that are weak or infirm. Also the stick of the present invention can be used to relieve pain in appendages. It can also be used to get in and out of a car, to turn over in bed, to climb steps, and to go down steps. It can be used as a leg rest or prop as well as an arm rest or prop and it helps people not only with weak or infirm appendages but also back ailments and the like.

In view of the above it is an object of the present invention to provide a multi-purpose stick for walking, resting, and manuevering.

Another object of the present invention is to provide a multi-purpose stick which allows a person to maneuver his appendages without outside help.

Another object of the present invention is to provide a multi-purpose stick which is curved so that it can be wrapped around appendages of the user to maneuver the same.

Another object of the present invention is to provide a multi-purpose stick which can be used as a prop for appendages.

Another object of the present invention is to provide a universal stick with a plurality of curved portions to allow the user thereof to maneuver his or her body and/or appendages without help from other parties.

Other objects and advantages of the present invention will become apparent and obvious from a study of the following description and the accompanying drawings which are merely illustrative of such invention.

DETAILED DESCRIPTION OF INVENTION

Figure 3:
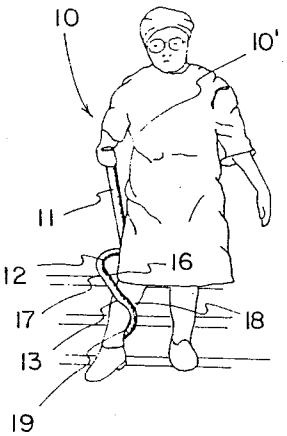
FIG. 3 is an elevational view of said stick rotated an additional 120 degrees.
Figure 2:
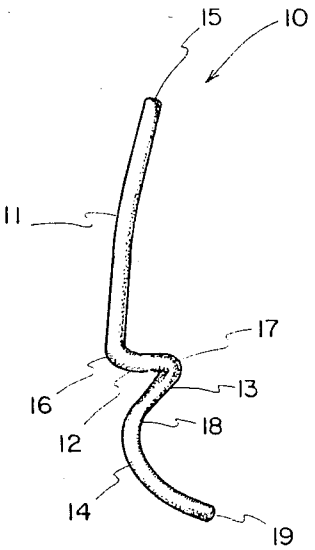
FIG. 2 is an elevational view of said stick rotated approximately 120 degrees.

With further reference to the drawings, the multi-purpose stick of the present invention, indicated generally at 10, includes a relatively straight elongtated portion 11, a first hook portion 12, a sloping second elongated portion 13 and a second lower hook portion 14.

The elongated portion 11 terminates at one end at end 15 and at the other end at 90 degree bend 16 which connects the straight portion 11 and the first hook portion 12.

First hook portion 12 extends from bend 16 in a curving manner which extends slightly downwardly to where it meets at 17 the downwardly sloping, second elongated portion 13. The opposite end of this sloping second elongated portion joins the second or lower hook portion 14 at 18.

Figure 1:
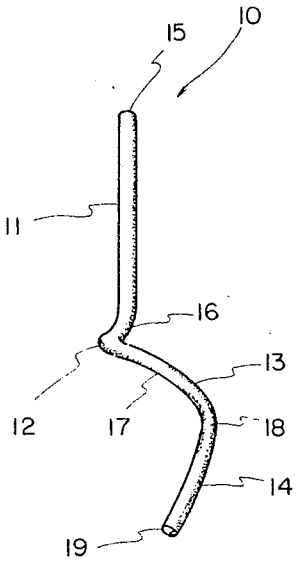
FIG. 1 is an elevational view of the multi-purpose stick of the present invention.

The radius of the second hook portion lies in a plane disposed at approximately 20 degrees to the axius of the first elongated portion 11 as can clearly be seen in FIG. 1. The end of the second hook portion, opposite where it joins at 18 the second elongated portion, terminates at lower end 19.

The size and overall length of the multi-purpose stick of the present invention can be varied to comfortably fit people of differing heights. It has been found that a multi-purpose stick as described above which is 37 inches from upper end 15 to lower end 19 is very suited for use by a person 6 feet tall. Rather than having to make a plurality of different sized sticks, the straight or first elongated portion 11 can be ajustable in length such as by telescoping with position locking means such as detents, twist locks, or the like. Since locking means for telescoping members are well known to those skilled in the art, further detailed discussion of the same is not deemed necessary.

The multi-purpose stick of the present invention can, of course, be used as a standard walking stick. Also the curved portion 14 terminating at end 19 can be used to more easily pick up items that a standard walking stick cannot, such as shoes, boxes, pans and other items since the curved portion allows the stick to come into flat contact with item being picked up whereas the standard walking stick cannot be so maneuvered.

Figure 4:
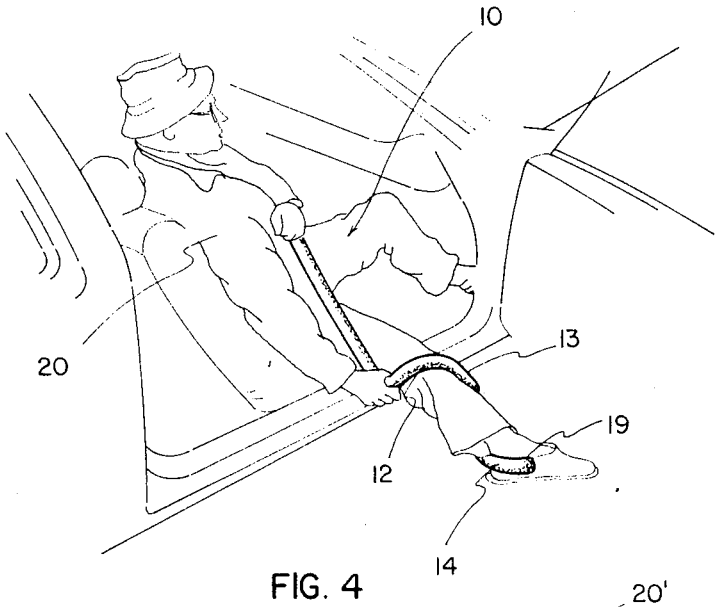
FIG. 4 is a perspective view of a person using the stick of the present invention to lift his leg into a vehicle.

There are numerous other examples of use of the multi-purpose stick of the present invention such as that illustrated in FIG. 4 where the user 20 is in the process of either getting into or out of an automobile where he is gripping the end 15 of the first elongated portion 11 with his left hand and the 90 degree bend 16 adjacent the first hook portion 12 with his right hand. The first hook portion encircles his leg with the second elongated portion 13 extending downwardly with the second hook portion 14 passing under the calf of his leg 23. It is easy for him to lift up on his right hand 21 with his left hand 22 guiding the end 15 of the stick 10 to maneuver the leg either into the car or out of the car. The stick 10 can then be twisted slightly to disengage it from the leg and it can be used in conjunction with the other leg if the user is getting out of the car. Thus, it can be seen that the user 20 can walk up to the car using the multi-purpose stick 10 of the present invention as a walking stick, turn, and while bracing on the stick sit down on the car seat. He can then use the stick to lift each of his legs into the car. With a person who is weak or infirm, this would, except for the present invention, be impossible without outside help.

Figure 5:
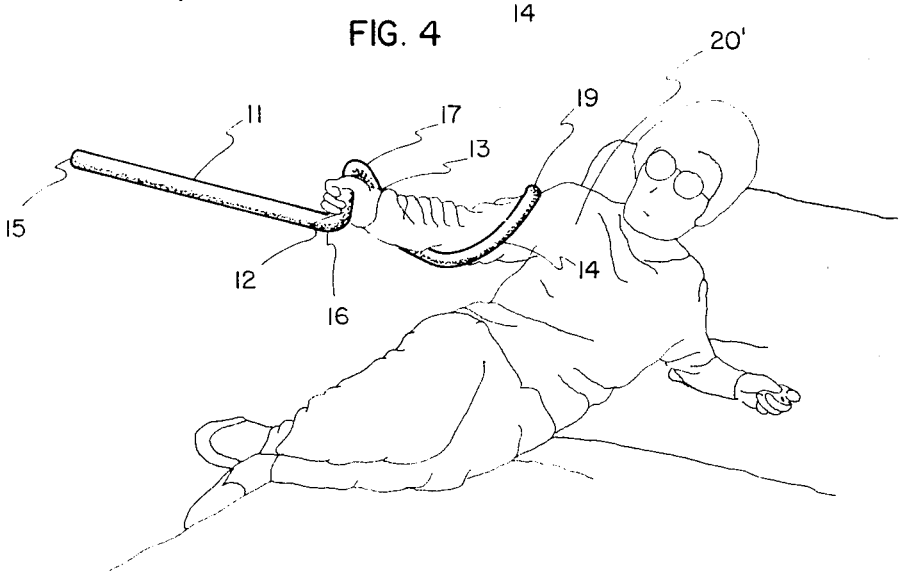
FIG. 5 is a perspective view of a person using the stick of the present invention to roll onto a bed.

The example shown in FIG. 5 is a person getting either into or out of a bed wherein the end 19 of the second hook portion 14 is placed under the arm of the user 20' and the first curved portion 12 is gripped with her hand. The stick 10 is thus firmly held by the user who can place the end 15 against the wall or other structure to push herself onto the bed or to brace herself when getting off the bed.

Figure 6:
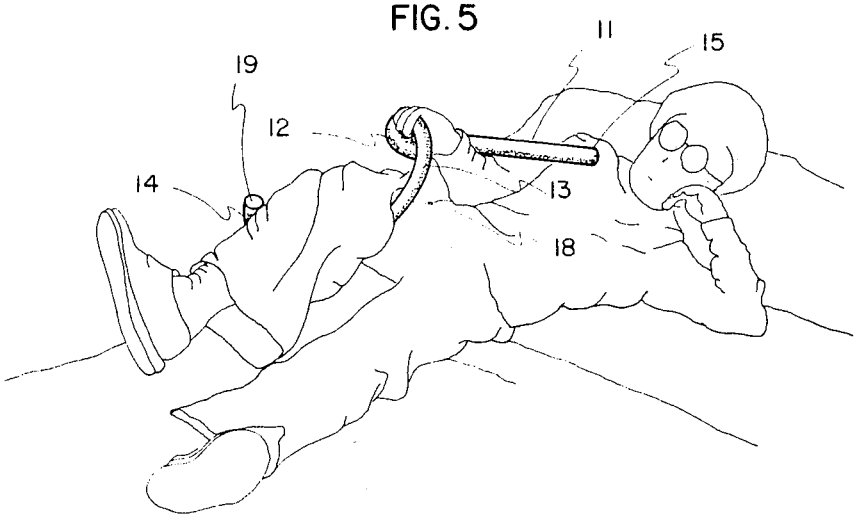
FIG. 6 is perspective view of a person using the stick of the present invention to move such such a person's leg onto a bed.

The example shown in FIG. 6 shows using the second hooked portion 14 about the leg of the user while gripping the first hook portion 12 adjacent its connection to the second elongated portion. This user 20'' is cradling the first elongated portion 11 in her arm with the end portion 15 against her shoulder.

Any number of other maneuvers can be accomplished with the multi-purpose, universal stick of the present invention and is limited only by the imagination of the user.

From the above it can be seen that the present invention is relatively inexpensive to produce, can include a means for varying the length of the first elongated portion, and is extremely useful to people with limited motor skills or strengths.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A multi-purpose stick comprising: a first end; a first elongated portion extending from said end to a first bend; a first hook portion connected to the end of said bend opposite said first elongated portion; a second elongated portion connected to the end of said first hook portion opposite said bend, the longitudinal axis of said second elongated portion being angularly disposed from the longitudinal axis of said first elongated portion; and a second hook portion connected to the end of said second elongated portion opposite its connection to said first hook portion and terminating at a second end and wherein said first bend, first hook portion, second elongated portion, and second hook portion form a generally elongated coiled section that defines an appendage containing space for receiving, enclosing, and supporting an appendage such that a user may move and position the enclosed appendage by moving the first end of the stick.

2. The multi-purpose stick of claim 1 wherein said bend is approximately 90 degrees.

3. The multi-purpose stick of claim 1 wherein the distance between said first end and said bend is approximately one-half of the overall distance between said first end and said second end.

4. A cane-like appendage support and moving structure comprising:

(a) a cane-like structure having a first end section;

(b) means extending from the first end section for encircling and supporting an appendage of a subject such that the subject may move the encircled and supported appendage by moving the cane-like support structure; and (c) wherein the means for encircling and supporting the appendage includes an elongated coiled section that defines an appendage opening through which a subject may extend a particular appendage, and wherein the elongated coiled section defines a side access opening through which the subject may insert or remove the appendage from the elongated coil section, whereby the cane-like appendage support structure may be utilized by the subject to support and move an appendage.

5. The cane-like appendage support structure of claim 4 wherein the elongated coiled section turns at least 360 degrees around the defined appendage opening.

6. The cane-like appendage support structure of claim 5 wherein the elongated coiled section includes a first bend of less than 180 degrees and wherein the first bend forms a generally right angle with respect to the first section.

7. The cane-like appendage support structure of claim 6 wherein the axis of the defined appendage opening extends generally parallel to the axis of the first section.

* * * * *